US011186935B2

(12) United States Patent
Kessler et al.

(10) Patent No.: US 11,186,935 B2
(45) Date of Patent: Nov. 30, 2021

(54) FLUSHING COMPARTMENT FOR STORAGE MONITORING

(71) Applicant: Henkel AG & Co. KGaA, Duesseldorf (DE)

(72) Inventors: Arnd Kessler, Monheim am Rhein (DE); Christian Nitsch, Duesseldorf (DE); Lars Zuechner, Langenfeld (DE); Georg Wawer, Vienna (AT); Alexander Mueller, Monheim (DE)

(73) Assignee: HENKEL AG & CO. KGAA, Duesseldorf (DE)

( * ) Notice: Subject to any disclaimer, the term of this patent is extended or adjusted under 35 U.S.C. 154(b) by 149 days.

(21) Appl. No.: 16/318,014

(22) PCT Filed: Jul. 11, 2017

(86) PCT No.: PCT/EP2017/067329
§ 371 (c)(1),
(2) Date: Jan. 15, 2019

(87) PCT Pub. No.: WO2018/011167
PCT Pub. Date: Jan. 18, 2018

(65) Prior Publication Data

US 2019/0301074 A1 Oct. 3, 2019

(30) Foreign Application Priority Data

Jul. 15, 2016 (DE) ..... 10 2016 212 982.1

(51) Int. Cl.
*D06F 33/37* (2020.01)
*D06F 34/14* (2020.01)
(Continued)

(52) U.S. Cl.
CPC ..... *D06F 33/37* (2020.02); *D06F 33/00* (2013.01); *D06F 34/14* (2020.02); *D06F 39/022* (2013.01);
(Continued)

(58) Field of Classification Search
CPC ..... D06F 33/00; D06F 33/37; D06F 39/02; D06F 39/022; D06F 2202/08;
(Continued)

(56) References Cited

U.S. PATENT DOCUMENTS 9,628,877 B2 4/2017 Metz
2001/0049846 A1 12/2001 Guzzi
(Continued)

FOREIGN PATENT DOCUMENTS

DE 10140323 A1 3/2003
DE 102009027875 A1 1/2011
(Continued)

OTHER PUBLICATIONS

Machine translation of EP 2311364 A2 to Groll. (Year: 2011).*
(Continued)

*Primary Examiner* — Joseph L. Perrin
(74) *Attorney, Agent, or Firm* — Lorenz & Kopf, LLP

(57) ABSTRACT

The present disclosure relates in particular to a device comprising a flushing device (10) and a sensor device (20), wherein the flushing device (10) is designed to receive or contain a cleaning agent, and wherein the flushing device (10) and the sensor device (20) are or can be integrated into a cleaning device (1). According to the present disclosure, the sensor device (20) is designed to determine a quantity information that is representative of the amount of cleaning agent filled into the flushing device (10).

17 Claims, 5 Drawing Sheets

(51) Int. Cl.

| | |
|---|---|
| ***D06F 33/00*** | (2020.01) |
| ***D06F 39/02*** | (2006.01) |
| *D06F 103/00* | (2020.01) |
| *D06F 103/22* | (2020.01) |
| *D06F 103/38* | (2020.01) |
| *D06F 105/58* | (2020.01) |

(52) U.S. Cl.
CPC ..... *D06F 2103/00* (2020.02); *D06F 2103/22* (2020.02); *D06F 2103/38* (2020.02); *D06F 2105/58* (2020.02)

(58) Field of Classification Search
CPC .. D06F 2204/08; D06F 2212/02; D06F 34/14; D06F 2103/00; D06F 2103/22; D06F 2103/38; D06F 2105/58
See application file for complete search history.

(56) References Cited

U.S. PATENT DOCUMENTS

2010/0000023 A1* 1/2010 McAllister ..... D06F 34/28 8/137
2010/0000024 A1* 1/2010 Hendrickson ..... D06F 34/28 8/137
2010/0101030 A1 4/2010 Kim
2011/0030729 A1* 2/2011 Gnadinger ..... A47L 15/4409 134/18
2012/0073335 A1 3/2012 Dunsbergen
2012/0280032 A1* 11/2012 Dunsbergen ..... D06F 39/02 235/375

FOREIGN PATENT DOCUMENTS

| | | | |
|---|---|---|---|
| EP | 2311364 | A2 | 4/2011 |
| EP | 2733249 | A2 | 5/2014 |
| EP | 2784205 | A1 | 10/2014 |
| JP | H07275569 | A | 10/1995 |

OTHER PUBLICATIONS

EPO, International Search Report and Written Opinion issued in International Application No. PCT/P2017/067329, dated Sep. 1, 2017.

* cited by examiner

FLUSHING COMPARTMENT FOR STORAGE MONITORING

CROSS-REFERENCE TO RELATED APPLICATION

This application is a U.S. National-Stage entry under 35 U.S.C. § 371 based on International Application No. PCT/EP2017/067329, filed Jul. 11, 2017 which was published under PCT Article 21(2) and which claims priority to German Application No. 10 2016 212 982.1, filed Jul. 15, 2016, which are all hereby incorporated in their entirety by reference.

TECHNICAL FIELD

The present disclosure relates to methods and devices which can in particular assist with the reordering of cleaning agents, and can be used for example for the automated reordering of cleaning agents.

BACKGROUND

Cleaning agents are used in a domestic setting for cleaning different objects, for example. For example, a cleaning agent, e.g. a detergent, is used in washing machines to clean textiles.

When automatic domestic washing machines of this kind are used for textiles, the detergent is generally metered from a storage container. In this case, the detergent is generally poured into the washing machine by employing a dispensing apparatus. As a result of the detergent being poured in, at the same time the user sets the amount to be metered. In this case, the detergent is generally metered before the washing process begins, i.e. before water flows through the dispensing apparatus.

The detergent is stored in the storage container. In this case, the user generally has to monitor the supply in the storage container manually and, if necessary, buy more of the corresponding detergent if the supply has been used up.

EP 2 784 205 A1 discloses inserting a storage container into a receiving apparatus on the domestic appliance, and coupling said storage container to the domestic appliance, instead of pouring the detergent in manually. This may well simplify the metering process and prevent too little or too much detergent from being metered, for example.

However, in any case, it may be that it is only when the user wishes to use the detergent that they realize that the detergent has been used up or is close to being used up and therefore cannot be used as planned.

Another problem is that a plurality of detergents are sometimes present. For example, there is often an all-purpose detergent, a color detergent, a bleaching agent, a detergent for black laundry and/or a softener available. Therefore, it may be difficult simply to get an appropriate overview. Additionally, the user has to note exactly which type of detergent has been used up so that they can also buy more of the correct detergent.

For overcoming this problem, it is known from the prior art in WO 01/96645 A2 to provide a storage container for a detergent with a fill level sensor or weight sensor in order to monitor the current inventory of detergent in the storage container. In this case, it is provided that an inventory module can order replacement detergent electronically if the fill level of the detergent reaches a predetermined fill level in the storage container.

This means that, in the prior art, the detergent is supplied directly by employing a fill level measurement and reordering is triggered at a predefined absolute fill level.

In this case, however, all storage containers, i.e. in particular conventional single-use packaging for detergents, have to be provided with an appropriate fill level sensor. When the contents of the storage container have been used up, it is not only the storage container that is disposed of, but also the fill level sensor provided therefor. However, this leads to uneconomical production when preparing the detergent or when producing the relevant packaging.

BRIEF SUMMARY

Devices and methods for determining quantity information which is representative of an amount of a cleaning agent which has been poured into a dispensing apparatus are provided herein. In an embodiment, a device includes a dispensing apparatus and a sensor apparatus. The dispensing apparatus is configured to receive or comprises a cleaning agent. The dispensing apparatus and the sensor apparatus are or are configured to be integrated in a cleaning device. The sensor apparatus is configured to determine quantity information which is representative of the amount of a cleaning agent which has been poured into the dispensing apparatus.

BRIEF DESCRIPTION OF THE DRAWINGS

The present disclosure will hereinafter be described in conjunction with the following drawing figures, wherein like numerals denote like elements, and wherein.

DETAILED DESCRIPTION

Figure 1:
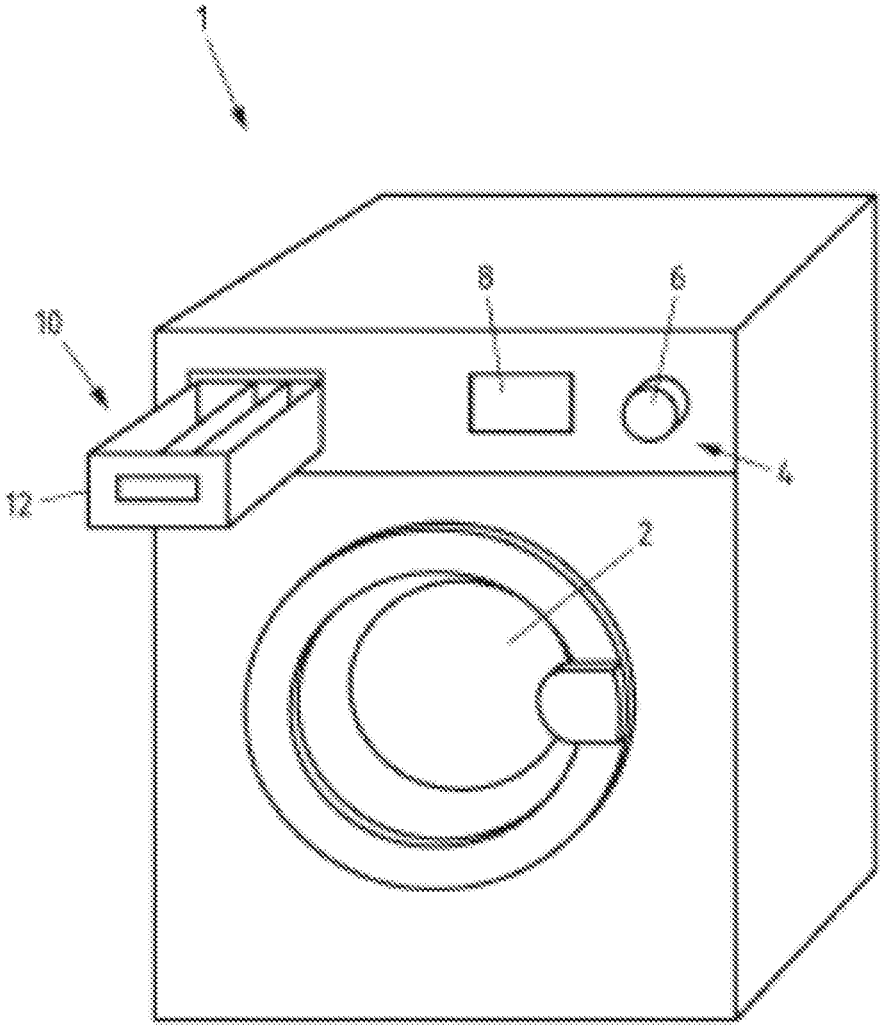
FIG. 1 is a schematic view of an embodiment of a cleaning device.

The following detailed description is merely exemplary in nature and is not intended to limit the disclosure or the application and uses of the subject matter as described herein. Furthermore, there is no intention to be bound by any theory presented in the preceding background or the following detailed description.

Against the background of the prior art set out, the problem addressed by the present disclosure is therefore to at least partially reduce or prevent the above-described problems, i.e. in particular to provide for simple reordering of cleaning agents for the user, while at the same time providing for economical production.

According to a first aspect of the present disclosure, a device is described, wherein the device comprises a dispensing apparatus and a sensor apparatus, wherein the dispensing apparatus is designed to receive a cleaning agent or contains a cleaning agent, wherein the dispensing apparatus and the sensor apparatus are or can be integrated in a cleaning device, and wherein the sensor apparatus is designed to determine quantity information which is representative of the amount of a cleaning agent which has been poured into the dispensing apparatus.

According to a second aspect of the present disclosure, a method is disclosed which is carried out by one or more devices, in particular including a device according to the first aspect, wherein the method comprises: obtaining quantity information which is representative of an amount of a cleaning agent which has been poured into a dispensing apparatus of a cleaning device; and checking, based at least in part on the determined quantity information, whether a supply of the cleaning agent is likely to be used up.

Whereas according to the first aspect the sensor apparatus is designed to determine quantity information, with the quantity information being representative of the amount of a cleaning agent which has been poured into the dispensing apparatus, according to the second aspect quantity information which is representative of an amount of a cleaning agent which has been poured into a dispensing apparatus of a cleaning device is obtained. It is then possible to check, based on said quantity information, whether a supply of the cleaning agent is likely to be used up.

A cleaning device is in particular understood to be a washing machine, in particular an automatic domestic washing machine.

The washing machine may have various different designs. A distinction is made between top-loading washing machines, in which the loading opening is on the top, and front-loading washing machines, in which a porthole on the front serves as the loading opening. An advantage of top-loading washing machines is that it is easier to construct the door seal and the drum can be supported on two sides by roller bearings, and a top-loading washing machine can also be positioned in very small spaces where there is not enough space to open a front door. By contrast, a front-loading washing machine provides space on top for e.g. a tumble dryer or for a worktop, and is therefore sometimes built into a kitchen unit instead of a floor unit. Top-loading washing machines are disadvantageous since they require a greater volume of water for washing laundry than front-loading washing machines.

American top-loading washing machines always have a rotating drum and mixing elements (agitators or discs), with the mixing elements being able to move in or counter to the rotational direction of the drum. The machines may comprise a suds circulator and injectors for the suds. In principle, a distinction is made between deep-fill and HE top-loading washing machines. Deep-fill top-loading washing machines operate at a specified water level, and therefore do not use any load detection. HE washing machines generally have load detection and control the amounts of water in accordance therewith. Generally, the machines do not have an integrated heater, but instead are connected to a hot water feed.

A dispensing apparatus is in particular understood to be a part of a cleaning device through which a liquid, for example water, is flushed in order to at least in part or completely feed a cleaning agent located therein into the cleaning process. For example, by employing the dispensing apparatus, a mixture of water and cleaning agent is fed into the cleaning process.

In principle, it is conceivable for the dispensing apparatus to be designed as a movable or immovable part of the cleaning device. For example, the dispensing apparatus is or comprises a dispensing chamber. For example, the dispensing apparatus is or comprises a drawer. For example, the dispensing apparatus comprises different compartments which can be provided for different cleaning agents. For example, a dispensing apparatus comprises a compartment for a pre-wash agent, a compartment for a main-wash agent and/or a compartment for a softener.

A dispensing apparatus is in particular understood to be a part of a cleaning device which is or can be permanently integrated in the cleaning device. In other words, it is therefore usually unlikely for a dispensing apparatus to be replaced when the cleaning device is in use, even though this may of course be possible. In principle, however, it is conceivable for the dispensing apparatus to also be provided in the form of a single-use or multi-use dispensing apparatus, for example a cartridge.

The sensor apparatus is also preferably designed to be permanently integrated or integrable in the cleaning device. For example, the sensor apparatus or a part thereof is integrated in a part of the cleaning device which is not likely to be replaced during use.

A sensor apparatus can for example comprise one or more sensors and optionally an electronics system.

A cleaning agent may be a detergent, for example. A cleaning agent is, however, intended to be understood to also mean cleaning agent aids or cleaning additives, such as a bleaching additive, a softener, or starch. A cleaning agent may also be a liquid, a disperse system, for example a gel or a foam, or a solid, in particular a tablet, powder, or granulate.

A cleaning agent may for example comprise one or more components from the group of components including surfactants, alkalis, builders, graying inhibitors, optical brighteners, enzymes, bleaching agents, soil-release polymers, fillers, plasticizers, fragrances, dyes, care substances, acids, starch, isomalt, sugar, cellulose, cellulose derivatives, carboxymethylcellulose, polyetherimide, silicone derivatives, and/or polymethylimines.

A cleaning agent may also comprise one or more other components. These components include, but are not limited to, the group of bleach activators, complexing agents, builders, electrolytes, non-aqueous solvents, pH adjusters, perfume carriers, fluorescing agents, hydrotropic substances, silicone oils, bentonites, anti-redeposition agents, shrinkage-preventing agents, crease-preventing agents, dye transfer inhibitors, anti-microbial active ingredients, germicides, fungicides, antioxidants, preservatives, corrosion inhibitors, antistatic agents, bittering agents, ironing aids, repellents or impregnating agents, anti-swelling or anti-slip agents, and/or UV absorbers.

Quantity information which is representative of the amount of a cleaning agent can be for example information from which the amount of cleaning agent can be derived, if necessary in combination with other information. Other information constitutes, for example, a conversion factor or other information known in advance, for example information on the dispensing apparatus, such as the size or geometry thereof. The quantity information can also even directly specify the amount of cleaning agent in an appropriate unit (for example a unit of volume such as the liter or cubic centimeter, or a unit of weight such as the gram). For example, the quantity information is stored as a data item or as data items, for example a data set.

The quantity information can be obtained, for example, from a part of the sensor apparatus. It is also conceivable for the quantity information to be obtained from the cleaning device. It is also possible for the quantity information to be obtained from a data processing system, for example a mobile device or a server.

A supply of the cleaning agent is for example a supply in a storage container. Checking whether a supply of the cleaning agent is likely to be used up can in particular comprise making an estimate or prediction, for example with regard to future consumption of the cleaning agent. For example, it can be assumed that a supply of the cleaning agent is likely to be used up if it is determined that the supply of the cleaning agent will be used up in an amount of time which is no more than or is less than a predetermined time. For example, it can be assumed that a supply of the cleaning agent is likely to be used up if it is determined that the supply of the cleaning agent will fall below a threshold value, has already reached said threshold value or has already fallen below said threshold value (in a predetermined time).

In order to check whether a supply of the cleaning agent is likely to be used up, reference can be made to additional information. For example, information which is representative of the starting or original amount of cleaning agent in the supply can be obtained. For example, obtaining the quantity information which is representative of an amount of a cleaning agent which has been poured into a dispensing apparatus of a cleaning device makes it possible to then reach a conclusion on the amount of cleaning agent in the supply by calculating the difference between the current amount and the amount of agent which has been poured in.

This means that it is no longer necessary to provide a sensor on all individual external storage containers for cleaning agents, from which the cleaning agent has to first be filled into the dispensing apparatus. Instead, it is possible to determine quantity information which is representative of the amount of cleaning agent which has been introduced into the cleaning device by employing the dispensing apparatus. The amount of cleaning agent therefore corresponds in particular to the amount which is used for a cleaning process. It is therefore advantageously unnecessary in particular for the remaining amount of cleaning agent in a supply of the cleaning agent to be observed directly; instead, the amount removed from a supply, i.e. the amount of cleaning agent used for a cleaning process, is utilized.

A device according to the first aspect may be for example the dispensing apparatus (comprising an integrated sensor apparatus). A device according to the first aspect may also be the cleaning device.

A device according to the first aspect may in particular be designed to carry out a method according to the second aspect or parts thereof.

The at least one device according to the second aspect may include for example the dispensing apparatus, the cleaning device and/or one or more data processing systems (in particular a mobile device and/or a server).

According to a preferred embodiment of the method according to the second aspect, the method further comprises determining the quantity information which is representative of an amount of a cleaning agent which has been poured into a dispensing apparatus of a cleaning device.

The quantity information which is representative of an amount of a cleaning agent which has been poured into a dispensing apparatus of a cleaning device can be determined for example by employing a sensor apparatus, in particular by means of a sensor apparatus according to the first aspect.

Said information can be determined, for example, while the cleaning agent is being introduced into the dispensing apparatus, when the cleaning agent is located in the dispensing apparatus and/or while the cleaning agent is being flushed out of the dispensing apparatus, i.e. is dispensed into the cleaning process.

According to a preferred embodiment of the device according to the first aspect, the sensor apparatus or a part thereof is integrated in the dispensing apparatus. For example, the dispensing apparatus and the sensor apparatus form a structural unit. As a result, a cleaning device comprising a conventional dispensing apparatus can be retrofitted for example with a device according to the first aspect.

In this case, it is preferable, in particular according to an embodiment of the device according to the first aspect, for the sensor apparatus or a part thereof to form a flow barrier of the dispensing apparatus or a part thereof. Therefore, further or additional parts that would, for example, adversely affect the flow behavior within the dispensing apparatus must not be provided in the dispensing apparatus, i.e. in particular within individual compartments. Instead, a part of the dispensing apparatus that is generally already present can be used to accommodate the sensor apparatus or at least a part thereof.

A flow barrier is in particular understood to be a part of a dispensing apparatus which reduces or prevents a cleaning agent, in particular a liquid cleaning agent, which has been poured into the dispensing apparatus from flowing past prematurely.

According to a preferred embodiment of the device according to the first aspect, the dispensing apparatus is designed to have water flushed therethrough in the cleaning device. For example, the dispensing apparatus comprises, for this purpose, a water inlet and an outlet for the mixture of water and cleaning agent such that said mixture can be fed into the cleaning process.

As already mentioned, it is in principle also possible for the dispensing apparatus to be designed as a (single-use or multi-use) cartridge which already contains a cleaning agent, and which is designed to have water flushed therethrough.

Correspondingly, according to a preferred embodiment of the method according to the second aspect, the method further comprises flushing water through the dispensing apparatus. As already mentioned, quantity information which is representative of an amount of a cleaning agent which has been poured into a dispensing apparatus of a cleaning device can be determined in particular during flushing.

According to a preferred embodiment of the device according to the first aspect, the sensor apparatus is designed to determine quality information which is representative of the type of the cleaning agent which has been poured into the dispensing apparatus.

Quality information which is representative of the type of the cleaning agent which has been poured into the dispensing apparatus can be for example information from which the type of the cleaning agent can be derived, if necessary in combination with other information. Other information constitutes, for example, information known in advance, as has already been described, e.g. information on the dispensing apparatus, such as the size or geometry thereof. The quality information can also specify one or more characteristic values of the cleaning agent, for example a determined chemical or physical property (e.g. conductivity, density, color, etc.) of the cleaning agent. The quality information can also even directly specify the type of the cleaning agent. For example, the quantity information is stored as a data item or as data items, for example a data set.

Correspondingly, according to a preferred embodiment of the method according to the second aspect, the method further comprises obtaining and/or determining quality information which is representative of the type of the cleaning agent which has been poured into the dispensing apparatus.

For example, the quantity information and the quality information are determined by employing the above-described sensor apparatus. For this purpose, the same sensor is used, for example, or various different sensors are used.

As already mentioned in connection with the determination of the quantity information, the quality information can also be determined while the cleaning agent is being introduced into the dispensing apparatus, when the cleaning agent is located in the dispensing apparatus and/or while the cleaning agent is being flushed out of the dispensing apparatus.

The quality information which is representative of the type of the cleaning agent which has been poured into the dispensing apparatus can be used to differentiate between different cleaning agents. For example, it can be established which cleaning agent from a plurality of cleaning agents of the user has been filled into the dispensing apparatus. As a result, it is possible to assign the determined quantity information to a particular (the correct) cleaning agent and to check whether a corresponding supply of the corresponding cleaning agent is likely to be used up. Therefore, the user can use different cleaning agents, and yet it is still possible to carry out a reliable check with regard to the relevant supply of cleaning agent.

According to a preferred embodiment of the device according to the first aspect, the sensor apparatus comprises an optical sensor, a conductivity sensor and/or a sensor which analyzes transit times.

An optical sensor includes, for example, a photodiode and optionally a light-emitting diode. For example, the (interior) space of the dispensing apparatus can be measured by employing an optical sensor. For example, the (free) space of the dispensing apparatus is measured before and after the cleaning agent has been poured in. The difference between the two measurements makes it possible to determine quantity information. Quality information of the cleaning agent can also be determined by employing an optical sensor, for example by the color or spectral properties of the cleaning agent which has been poured in being determined.

A conductivity sensor comprises for example two (or more) electrodes. These are arranged such that they come into contact with the cleaning agent in the dispensing apparatus. The quantity information and/or the quality information can be determined by employing the conductivity sensor. If, for example, the conductivity of the cleaning agent which has been filled into the dispensing apparatus is determined, this corresponds to a basic conductivity. Knowing the conductivity level makes it possible to draw a conclusion on the type of the cleaning agent. The quantity information can be determined, for example, as follows: after the (basic) conductivity of the cleaning agent which has been filled into the dispensing apparatus has preferably been determined, the change in conductivity over time during dispensing of the cleaning agent is determined (for example continuously or repeatedly at intervals). It is possible to draw a conclusion on the amount of cleaning agent on the basis of the change in conductivity (for example the speed of the change, or the duration until the conductivity falls below a conductivity value). This is because the conductivity of the cleaning agent is reduced by dilution with water more quickly or more slowly depending on the amount which has been poured in.

For example, the conductivity sensor comprises film electrodes. For example, the electrodes extend transversely (e.g. about 90°) to the flow direction of the cleaning agent or water during dispensing. For example, the electrodes extend at least in portions along the wall of the dispensing apparatus. As a result, the surface area of the electrodes covered by the cleaning agent increases as the amount of cleaning agent increases, since the fill level of the cleaning agent increases. The covered surface area influences conductivity in accordance with:

$$\sigma=(I\cdot L)/(U\cdot A),$$

where I is the electric current, U is the electrical voltage, L is the electrode gap and A is the electrode surface area. The higher the fill level of the cleaning agent (and thus the amount of cleaning agent in the dispensing apparatus), the larger the covered electrode surface area. If the remaining variables are known, the covered electrode surface area, and thus the fill level and the amount of cleaning agent, can be determined. Therefore, in this case, the quantity information can also be determined, for example, on the basis of a (stationary) conductivity value, without having to refer to the change in conductivity over time.

A sensor which analyzes transit times comprises, for example, a transmitter and a receiver. For example, the sensor which analyzes transit times is an optical sensor, an ultrasound-based sensor or a radar-based sensor. For example, a pulse is emitted from the transmitter. The pulse transit time is the time that the pulse needs in order to be reflected toward the receiver. By measuring this transit time, it is possible to calculate a distance from the speed. Therefore, the transit time can be used as a measure for the fill level. In this case, it should be noted that the speed of light through the surrounding medium is reduced by the refractive index n. In this respect, the transit time has a substance-dependent component. Therefore, on the basis of a sensor which analyzes transit times, it is possible to determine not only quantity information, but also quality information.

According to a preferred embodiment of the device according to the first aspect, the device comprises a communication interface.

For example, the communication interface is designed for wired or wireless communication. For example, the communication interface is a network interface. The communication interface is preferably designed to communicate with a communication system. Examples of a communication system are a local network (LAN), a wide area network (WAN), a wireless network (for example in accordance with the IEEE-802.11 standard, the Bluetooth (LE) standard and/or the NFC standard), a wired network, a mobile network, a telephone network, and/or the Internet.

For example, the device, e.g. as a dispensing apparatus having an integrated sensor apparatus, can communicate with the cleaning device or with another device, for example with another data processing system, such as a mobile device or a server.

According to a preferred embodiment of the device according to the first aspect, the device is or comprises the cleaning device, in particular a washing machine. The cleaning device then comprises the dispensing apparatus and the sensor apparatus. A washing machine is in particular an automatic domestic washing machine for textiles. The sensor apparatus is preferably provided in the region of the dispensing apparatus and is in particular a part thereof, as already described.

According to a preferred embodiment of the method according to the second aspect, the method further comprises determining a consumption profile based at least in part on the obtained quantity information, in particular based on a plurality of pieces of obtained quantity information, wherein the check as to whether a supply of the cleaning agent is likely to be used up is based at least in part on the determined consumption profile.

In this case, according to a preferred embodiment of the method according to the second aspect, the consumption profile is representative of the time curve of consumption of the cleaning agent.

A consumption profile can comprise, for example, one or more data sets, with each data set comprising time information and quantity information associated with the time information. The time information is therefore representative of the point in time at which a level of cleaning agent consumption is reached, which level is specified by the quantity information which is representative of the amount of cleaning agent which has been poured into the dispensing apparatus. For example, the data set can also contain quality information in order to assign the consumption information to a particular cleaning agent.

The quantity information (and optionally the quality information) is therefore determined in particular repeatedly (for example at at least some, in particular all, of the cleaning processes). Correspondingly, the quantity information (and optionally the quality information) is obtained repeatedly. The consumption profile therefore takes into account individual consumption behavior of the user, and this can increase the accuracy of a prediction as to when a supply of the cleaning agent is likely to be used up. For example, in this case, it can be expected that a supply of the cleaning agent will be used up when the determined consumption profile leads to the assumption that the supply will be used up within a predefined duration of time.

It is also possible for the process of repeatedly obtaining and/or determining the quantity information and/or quality information to be used for machine learning.

This means that the consumption profile can for example be determined based at least in part on machine learning. Machine learning is understood to mean that an artificial system (for example a device according to the second aspect or a system according to the third aspect) learns from examples, and can generalize said examples following the learning phase. This mean that it does not simply learn the examples by heart, but that patterns and regularities are recognized in the learning data. Various approaches can be taken for this purpose. For example, supervised learning, semi-supervised learning, unsupervised learning, reinforcement learning and/or active learning can be used. Supervised learning can for example be carried out by employing an artificial neural network (such as a recurrent neural network) or by employing a support vector machine. In addition, unsupervised learning can for example be carried out by employing an artificial neural network (for example an autoencoder). In particular the repeatedly obtained and/or determined quantity information and/or quality information is used as learning data, for example.

Alternatively or additionally, it is conceivable for the obtained and/or determined quantity information and/or quality information to be associated with other information, for example with the number and/or the age of the person(s) in a household in order to produce a personalized consumption profile, or for example with the seasons in order to produce a seasonal consumption profile.

As a result of these measures, the reliability of a check as to whether a supply of the cleaning agent is likely to be used up is increased.

According to a preferred embodiment of the method according to the second aspect, the method further comprises ordering or triggering ordering of a supply of the cleaning agent if the result of the check is that a supply of the cleaning agent is likely to be used up.

The method can therefore be considered in particular to be a method for the automated reordering of a cleaning agent. For example, the ordering or the triggering thereof comprises transmitting information which uniquely identifies a product, for example an item number, a product label, a product name and/or a specified amount. In this case, the user does not have to worry about monitoring the supply or reordering the cleaning agent in order to replenish the supply.

According to a preferred embodiment of the method according to the second aspect, the method further comprises outputting or triggering output of an indication to a user that a supply of the cleaning agent is likely to be used up if the result of the check is that a supply of the cleaning agent is likely to be used up.

For example, an indication can be given on the cleaning device (for example on a display element of the cleaning device) and/or on a mobile device of the user. For example, the indication comprises an optical, acoustic and/or haptic signal for the user. The user can be informed hereby that a supply of the cleaning agent is likely to be used up. The user can in this case manually order a supply of the cleaning agent.

According to a preferred embodiment of the method according to the second aspect, the method further comprises outputting or triggering output of an indication to a user relating to the amount of a cleaning agent which has been poured into a dispensing apparatus of a cleaning device.

For example, it is indicated to the user what amount (for example in milliliters) of cleaning agent has been filled into the dispensing apparatus. For example, the user is informed when too little cleaning agent, a sufficient amount of cleaning agent and/or too much cleaning agent has been filled into the dispensing apparatus. For example, an indication can be given on the cleaning device (for example on a display element of the cleaning device) and/or on a mobile device of the user. For example, the indication comprises an optical, acoustic and/or haptic signal for the user. This provides for precise metering for example when no metering aid is used.

According to a preferred embodiment of the method according to the second aspect, the method further comprises establishing that the cleaning agent has been flushed out of the dispensing apparatus. Furthermore, according to an embodiment of the method according to the second aspect, the process of flushing water through the dispensing apparatus is preferably brought to an end when it is established that the cleaning agent has been flushed out of the dispensing apparatus.

In particular, the above-described sensor apparatus can be used to establish when the cleaning agent has been flushed out of the dispensing apparatus. Therefore, this is preferably based on a signal from the sensor apparatus. As has already been described, the conductivity of the cleaning agent changes as a result of dilution with water. As a result, it can be determined for example by employing a conductivity sensor whether the dispensing apparatus has been flushed out (for example when the conductivity falls below a specified threshold value or when the conductivity corresponds substantially to that of water).

This is advantageous, for example, if a low liquor ratio (ratio of objects to be cleaned to liquor) is intended to be set, i.e. only a small amount of water is intended to be used, and yet the intention is to ensure that all of the cleaning agent is flushed out of the dispensing apparatus. This can be advantageous, for example, in certain cleaning agents (for example microemulsions). However, in principle, it may also be desirable for as low a liquor ratio as possible to be set, for example in order to save energy and/or water.

According to the second aspect of the present disclosure, a device is also described that is designed or comprises corresponding features for carrying out and/or controlling a method according to the second aspect.

According to the second aspect of the present disclosure, a device is also described which comprises at least one processor and at least one memory comprising computer program code, wherein the at least one memory and the computer program code are designed to carry out and/or control at least one method according to the second aspect using the at least one processor. A processor is for example intended to be understood to mean a control unit, a microprocessor, a microcontrol unit such as a microcontroller, a digital signal processor (DSP), an application-specific integrated circuit (ASIC) or a field-programmable gate array (FPGA).

For example, an exemplary device further comprises features for storing information, such as a program memory and/or a main memory. For example, an exemplary device according to the present disclosure further comprises features for respectively receiving and/or transmitting information over a network, such as a network interface. For example, exemplary devices according to the present disclosure are and/or can be interconnected via one or more networks.

An exemplary device according to the second aspect for example is or comprises a data processing system set up using software and/or hardware in order to execute the respective steps of an exemplary method according to the second aspect. Examples of a data processing system are a computer, a desktop computer, a server, a thin client and/or a portable computer (mobile device), such as a laptop computer, a tablet computer, a wearable, a personal digital assistant or a smartphone.

This means in particular that individual method steps of the method according to the second aspect (for example that of obtaining or determining information, checking whether the cleaning agent is going to be used up imminently and/or determining a consumption profile) can be carried out in this case by employing the device which also comprises the sensor apparatus. Likewise, individual method steps (for example that of obtaining information, checking whether the cleaning agent is going to be used up imminently and/or determining a consumption profile) which do not necessarily need to be carried out by employing the sensor apparatus can be carried out by another device that is connected, in particular by employing a communication system, to the device comprising the sensor apparatus. Another device of this kind may be for example a server and for example a part or component of a computer cloud, which provides data processing resources dynamically for different users in a communication system. A computer cloud is in particular understood to be a data processing infrastructure in accordance with the definition from the National Institute for Standards and Technology (NIST) for the term "cloud computing." One example of a computer cloud is a Microsoft Windows Azure platform.

According to the second aspect of the present disclosure, a computer program is also described that comprises program instructions that prompt a processor to execute and/or control a method according to the second aspect when the computer program runs on the processor. An exemplary program according to the present disclosure may be stored in or on a computer-readable memory medium which contains one or more programs.

According to the second aspect of the present disclosure, a computer-readable memory medium is also described which contains a computer program according to the second aspect. A computer-readable memory medium can be designed, for example, as a magnetic, electrical, electromagnetic, optical and/or different memory medium. A computer-readable memory medium of this type is preferably a physical object (i.e. "tangible"); for example, it is designed as a data carrier device. A data carrier device of this kind is for example portable or permanently installed in a device. Examples of a data carrier device of this type are volatile or non-volatile memories with random access (RAM), such as NOR flash memories, or with sequential access, such as NAND flash memories, and/or memories with read-only access (ROM) or read/write access. Computer-readable is for example intended to be understood to mean that the memory medium can be read and/or written by a computer or a data processing system, for example by a processor.

According to a third aspect of the present disclosure, a system is also described that comprises a plurality of devices, in particular including a device according to the first aspect, which together carry out a method according to the second aspect.

An exemplary system according to the third aspect comprises an exemplary device according to the first aspect (i.e. for example a dispensing apparatus comprising an integrated sensor apparatus) and additionally another device, for example a cleaning device, a mobile device or a server for carrying out an exemplary method according to the second aspect.

The exemplary embodiments of the present disclosure described above in this description are also intended to be understood to be disclosed in any combination with one another. In particular, exemplary embodiments are intended to be understood to be disclosed in relation to different aspects.

Further advantageous, exemplary embodiments of the present disclosure are found in the following detailed description of some exemplary embodiments of the present disclosure, in particular in conjunction with the drawings. The drawings are however only provided for illustrative purposes, and do not serve to define the scope of protection of the present disclosure. The drawings are not to scale and are merely intended to provide an example of the general concept of the present disclosure. In particular, features contained in the drawings are not in any way intended to be considered as necessary components of the present disclosure.

FIG. 1 shows a cleaning device 1. The cleaning device 1 can be an embodiment of a device of the first, second or third aspect. The cleaning device 1 is in this case an automatic domestic washing machine for textiles, which is designed as a drum washing machine in which a laundry drum 2 rotates about a horizontal axis. The washing machine 1 comprises, in addition to the drum 2, user interfaces 4 in the form of an operating element 6 and a display element 8. The operating element 6 is in the form of a rotary knob, and can be used to set various washing parameters, for example the washing program and the washing temperature. The display element 8 can display information visually to the user. However, the washing machine 1 can also comprise further user interfaces. The washing machine 1 further comprises a dispensing apparatus 10 which comprises a dispensing drawer 12. The dispensing apparatus 10 or the dispensing drawer 12 can also be an embodiment of a device according to the first or second aspect.

Figure 2:
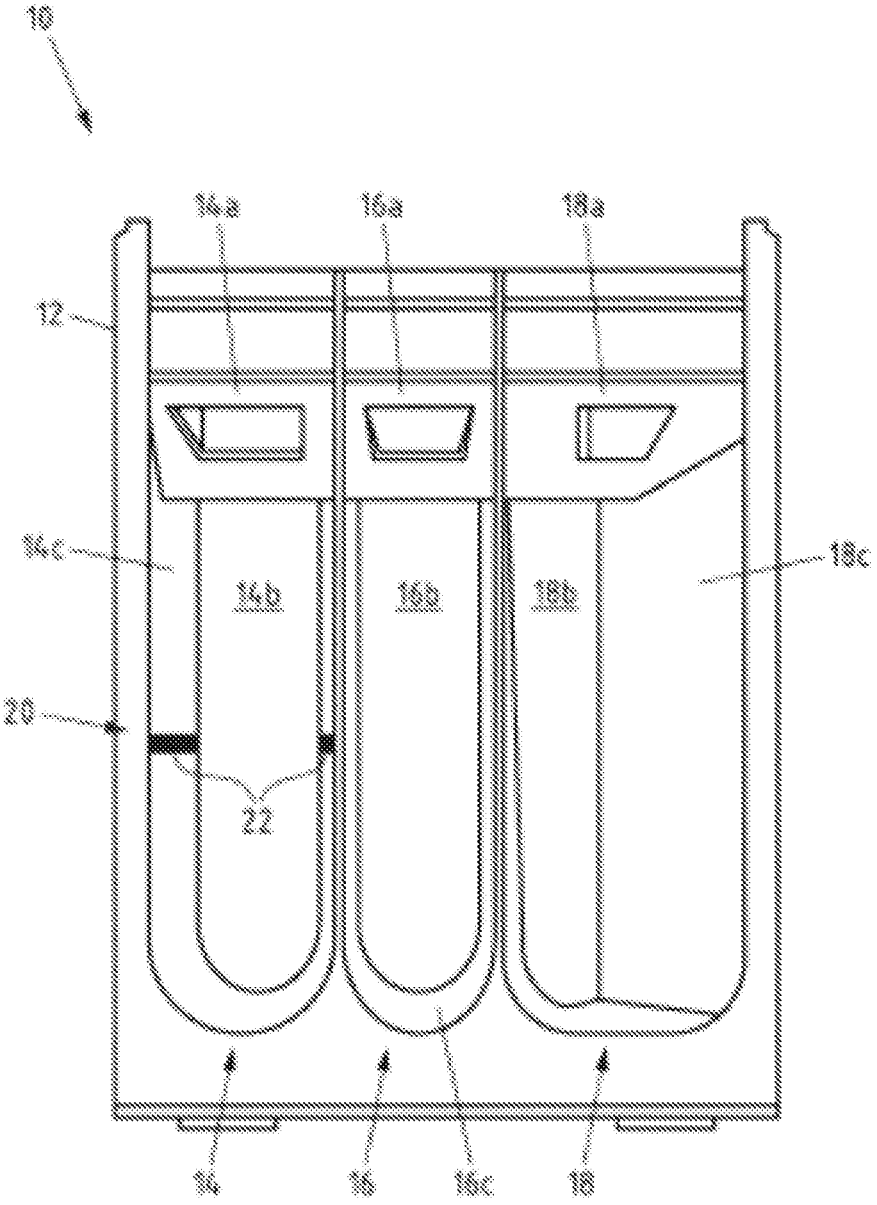
FIG. 2 is an enlarged view of an embodiment of a dispensing apparatus.

FIG. 2 is an enlarged view of the dispensing drawer 12. The dispensing drawer 12 comprises in this case three compartments 14, 16, 18 which are each designed to receive a cleaning agent (not shown). The compartments 14, 16, 18 are for example a compartment for receiving a detergent for a pre-wash process, a compartment for receiving a detergent for the main-wash process, and a compartment for receiving a softener. Each of the compartments 14, 16, 18 comprises a flow barrier 14*a*, 16*a*, 16*a*. The compartments each comprise a base 14*b*, 16*b*, 18*b* and side walls 14*c*, 16*c*, 18*c*.

The compartment 14 of the dispensing drawer 12 further comprises a sensor apparatus 20 comprising at least one sensor. The sensor is in the form of a conductivity sensor comprising two electrodes 22 which are in the form of film electrodes along the side wall 14*c* of the compartment 14. The sensor apparatus 20 or at least a part thereof is thus integrated in the dispensing apparatus 10. It would also be conceivable for the sensor apparatus 20 or at least one particular sensor to be integrated in a corresponding flow barrier 14*a*, 16*a*, 18*a* such that the sensor or the sensor apparatus 20 can in particular replace the corresponding flow barrier. Alternatively or additionally, it would be conceivable for other sensors, for example optical sensors and/or sensors which analyze transit times, to be provided. Likewise, the other compartments 16, 18 can also comprise a corresponding or different sensor. The sensor apparatus 20 is designed to determine quantity information and quality information.

Figure 3:
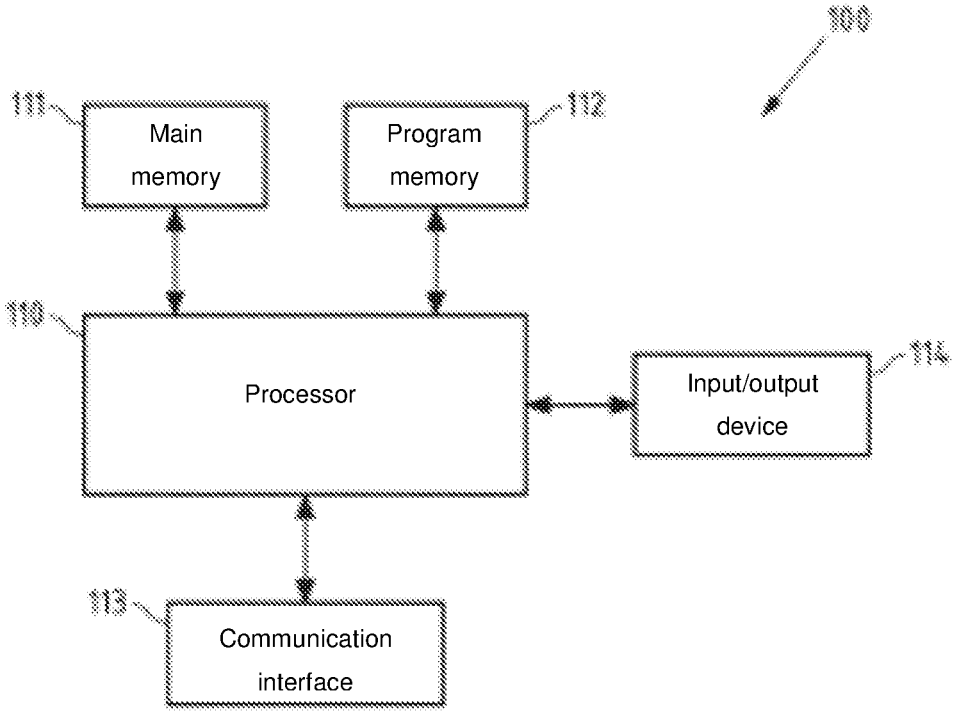
FIG. 3 is a block diagram of an embodiment of a device.

FIG. 3 is a block diagram of an embodiment of a device 100, which in particular can carry out an exemplary method according to the second aspect. The device 100 is for example a device according to the second or third aspect. Individual components or all components shown can however also be implemented in a device according to the first aspect, i.e. for example in the dispensing apparatus 10 or in the cleaning device 1.

In this respect, the device 100 may for example be a computer, a desktop computer, a server, a thin client or a portable computer (mobile device), such as a laptop computer, a tablet computer, a personal digital assistant (PDA) or a smartphone. The device may for example perform the function of a server or a client.

The processor 110 of the device 100 is in particular designed as a microprocessor, a microcontrol unit, a microcontroller, a digital signal processor (DSP), an application-specific integrated circuit (ASIC) or a field-programmable gate array (FPGA).

The processor 110 executes program instructions that are stored in the program memory 112, and for example stores intermediate results or the like in a working memory or main memory 111. For example, the program memory 112 is a non-volatile memory such as a flash memory, a magnetic memory, an EEPROM memory (electrically erasable, programmable read-only memory), and/or an optical memory. The main memory 111 is for example a volatile or non-volatile memory, in particular a memory with random access (RAM) such as a static RAM memory (SRAM), a dynamic RAM memory (DRAM), a ferroelectric RAM memory (FeRAM), and/or a magnetic RAM memory (MRAM).

The program memory 112 is preferably a local data carrier that is permanently connected to the device 100. Data carriers that are permanently connected to the device 100 are for example hard drives that are integrated in the device 100. Alternatively, the data carrier may for example also be a data carrier that can be detachably connected to the device 100, such as a memory stick, a removable data carrier, a portable hard drive, a CD, a DVD, and/or a floppy disk.

The program memory 112 for example contains the operating system of the device 100, which is loaded in the main memory 111 at least in part and is executed by the processor 110 when the device 100 is started up. In particular, when starting up the device 100, at least part of the core of the operating system is loaded in the main memory 111 and executed by the processor 110. The operating system of the device 100 is for example a Windows, UNIX, Linux, Android, Apple iOS and/or MAC operating system.

The operating system in particular allows the device 100 to be used for data processing. It for example manages operating equipment such as the main memory 111 and the program memory 112, the network interface 113, and the input and output device 114, inter alia provides basic functions by employing programming interfaces of other programs, and controls the execution of programs.

The processor 110 controls the communication interface 113, which for example may be a network interface and may be designed as a network card, network module, and/or modem. The communication interface 113 is in particular designed to establish a connection between the device 100 and other devices, in particular via a (wireless) communication system, for example a network, and to communicate therewith. The communication interface 113 may for example receive data (via the communication system) and forward said data to the processor 110, and/or receive and transmit data from the processor 110 (via the communication system). Examples of a communication system are a local network (LAN), a wide area network (WAN), a wireless network (for example in accordance with the IEEE-802.11 standard, the Bluetooth (LE) standard and/or the NFC standard), a wired network, a mobile network, a telephone network, and/or the Internet.

Furthermore, the processor 110 can control at least one input/output device 114. The input/output device 114 is for example a keyboard, a mouse, a display unit, a microphone, a touch-sensitive display unit, a speaker, a read device, a drive, and/or a camera. The input/output device 114 may for example receive user inputs and forward said inputs to the processor 110, and/or receive and output information for the user from the processor 110.

Figure 4:
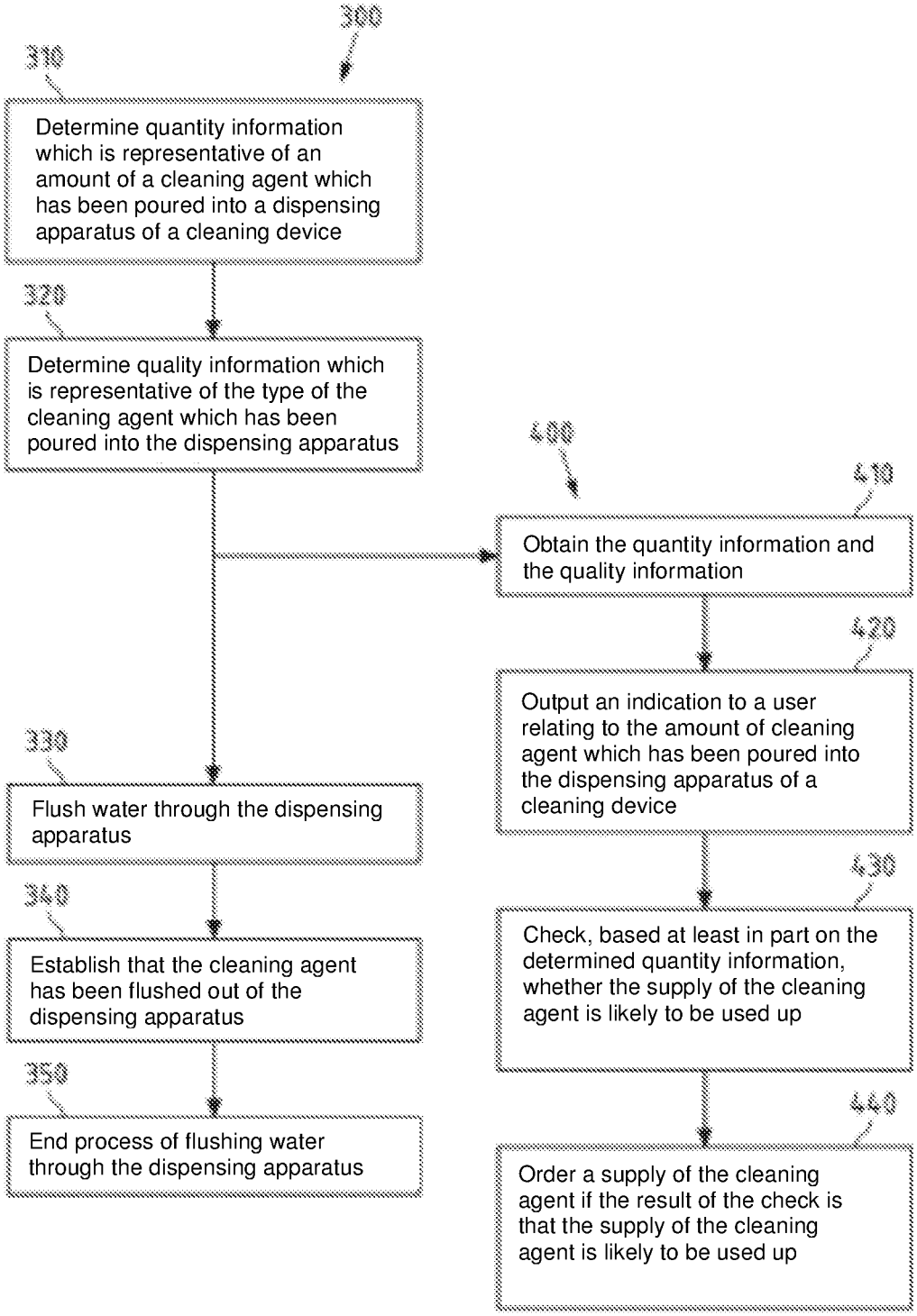
FIG. 4 shows two block diagrams of an embodiment of a method.

FIG. 4 shows two flow diagrams of an embodiment of a method according to the second aspect, which is carried out by the cleaning device 1 (flow diagram 300) and another device, for example a mobile device (flow diagram 400). In principle, however, the actions in the flow diagram 400 can also be carried out by the device 1.

Firstly, quantity information which is representative of an amount of a cleaning agent which has been poured into the dispensing apparatus 10 of the cleaning device 1 is determined (action 310). This is carried out by employing the electrodes 22 of the sensor apparatus 10. At the same time, quality information which is representative of the type of the cleaning agent which has been poured into the dispensing apparatus 10 is determined using the sensor apparatus 10 by employing the same or a different sensor (action 320). As a result, both the type of the cleaning agent used and the amount of the cleaning agent used can be determined.

This information is provided, for example by employing a communication apparatus of the dispensing apparatus 10 or the cleaning device 1, to another device 100, for example a mobile device. The other device obtains the quantity information and the quality information (action 410). The device 100 outputs an indication directly to the user and informs them of the amount of cleaning agent which has been poured into a dispensing apparatus 10 of the cleaning device 1.

The device 100 also checks, based at least in part on the determined quantity information, whether a supply of the cleaning agent is likely to be used up (action 430). For example, the device has access to information relating to the amount of the current supply of the cleaning agent. For example, the starting supply amount is manually input. By updating the amount in the supply each time the cleaning agent is used, the information relating to the amount in the supply can be kept up to date. If the result of the check is that the supply of the cleaning agent is likely to be used up, a supply of the cleaning agent is ordered (action 440).

The actions in the flow diagram 300 can be continued independently of the actions in the flow diagram 400. Once the cleaning agent has been poured into the dispensing apparatus 10, the cleaning process is started. Water is flushed through the dispensing apparatus 10. On the basis of the change in the conductivity measured by employing the sensor, it can be established that the cleaning agent has been flushed out of the dispensing apparatus 10 (action 340). Then, the process of flushing water through the dispensing apparatus 10 can be brought to an end (action 350). This makes it possible to set a low liquor ratio and additionally to reduce the water and energy consumption.

Figure 5:
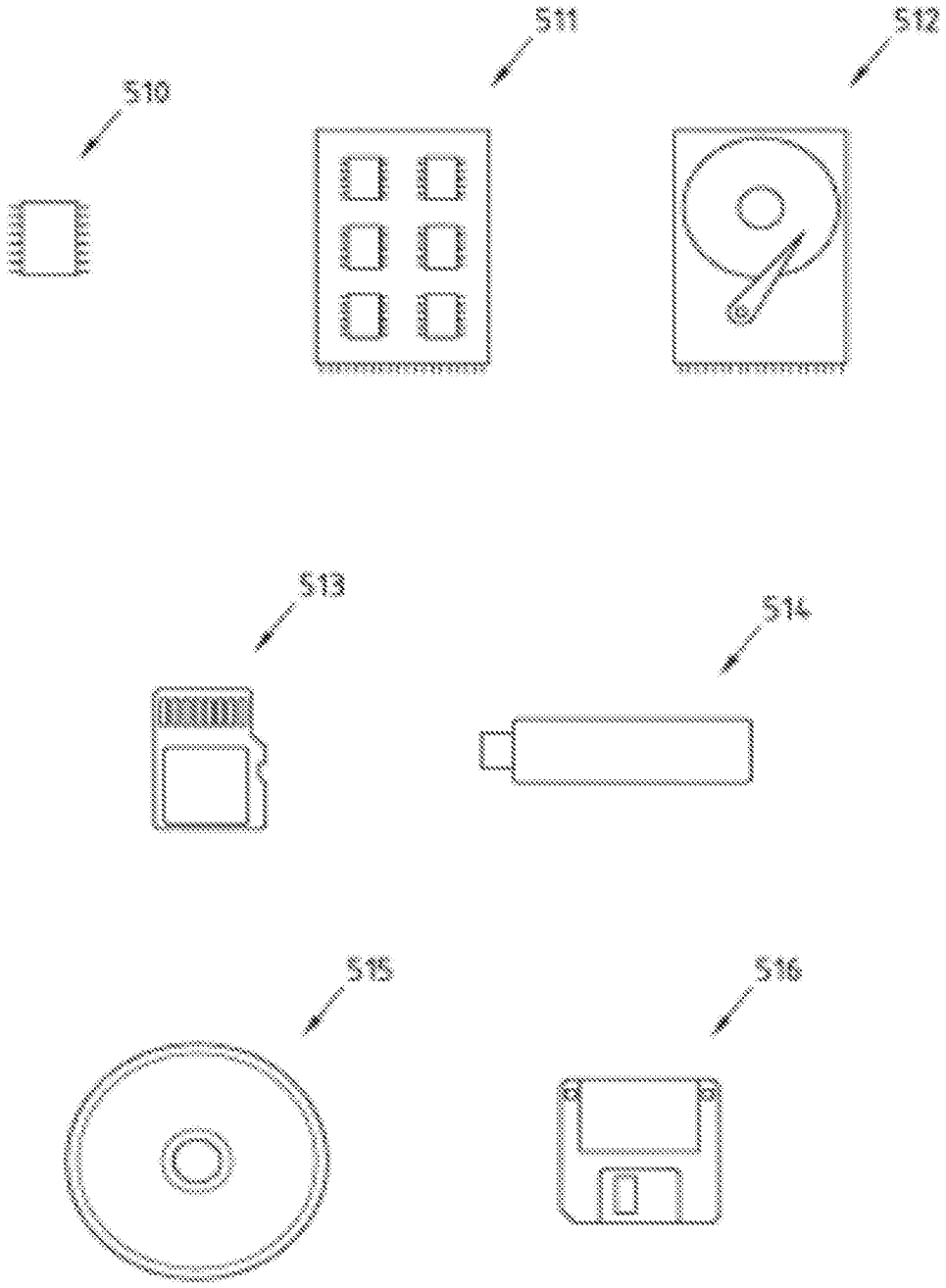
FIG. 5 shows different embodiments of a memory medium.

FIG. 5 lastly shows different embodiments of memory media on which an embodiment of a computer program according to the present disclosure can be stored. The memory medium may for example be a magnetic, electrical, optical and/or different memory medium. The memory medium may for example be a part of a processor (e.g. the processor 110 from FIG. 3), for example a (non-volatile or volatile) program memory of the processor, or a part thereof (such as the program memory 112 in FIG. 3). Embodiments of a memory medium are a flash memory 510, an SSD hard drive 511, a magnetic hard drive 512, a memory card 513, a memory stick 514 (e.g. a USB stick), a CD-ROM or DVD 515, or a floppy disk 516.

The embodiments of the present disclosure described in this specification and the optional features and properties set out in this regard in each case are also intended to be understood to be disclosed in any combination with one another. In particular, unless explicitly stated otherwise, the description of a feature included in an embodiment should not be understood in the present case such that the feature is indispensable or essential for the function of the embodiment. The sequence of the method steps set out in this specification in the individual flow diagrams is not compulsory, and alternative sequences of the method steps are conceivable. The method steps can be implemented in different ways, and therefore implementation in software (by employing program instructions), hardware, or a combination of both are conceivable for implementing the method steps.

Terms used in the claims such as "comprise," "have," "include," "contain" and the like do not exclude additional elements or steps. The wording "at least in part" covers both "partly" and also "completely." The wording "and/or" is intended to be understood such that both the alternative and the combination are intended to be disclosed, i.e. "A and/or B" means "(A) or (B)" or "(A and B)." The use of the indefinite article does not exclude a plurality. An individual device can perform the function of a plurality of units or devices mentioned in the claims. Reference signs in the claims should not be considered limiting to the features and steps used.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A method for operating a device comprising a dispensing apparatus and a sensor apparatus, wherein the dispensing apparatus is configured to receive cleaning agents, and wherein the dispensing apparatus and the sensor apparatus are or are configured to be integrated in a cleaning device, the method comprising:

starting a process of flushing water through the dispensing apparatus, sensing, with the device, that an initial cleaning agent initially present in the dispensing apparatus has been flushed out of the dispensing apparatus, in response to sensing that the initial cleaning agent has been flushed out of the dispensing apparatus, ending, with the device, the process of flushing water through the dispensing apparatus, sensing, with the sensor apparatus, added incremental amounts of an added cleaning agent which has been poured into the dispensing apparatus, monitoring, with the device, quantity information representative of a total amount of the added cleaning agent which has been poured into the dispensing apparatus in the added incremental amounts, and determining a consumption profile, with the device, based at least in part on the quantity information, and determining, with the device, whether a supply of the added cleaning agent is likely to be used up within a selected period of time, based at least in part on the quantity information and the consumption profile.

2. The method according to claim 1, wherein the sensor apparatus or a part thereof is integrated in the dispensing apparatus, wherein the sensor apparatus or a part thereof forms a flow barrier of the dispensing apparatus or a part thereof.

3. The method according to claim 1, further comprising determining, with the sensor apparatus, quality information which is representative of the type of the added cleaning agent which has been poured into the dispensing apparatus.

4. The method according to claim 1, wherein the device comprises a communication interface.

5. The method according to claim 1, wherein the device is or comprises a washing machine.

6. The method according to claim 1, the method further comprising determining, with the device, quality information which is representative of the type of the added cleaning agent which has been poured into the dispensing apparatus.

7. The method according to claim 1, wherein the consumption profile is representative of a time curve of consumption of the added cleaning agent.

8. The method according to claim 1, wherein, when the device determines that the supply of the added cleaning agent is likely to be used up within the selected period of time, the method further comprises ordering or triggering ordering, with the device, of a supply of the added cleaning agent.

9. The method according to claim 1, wherein, when the device determines that the supply of the added cleaning agent is likely to be used up, the method further comprises outputting or triggering output, with the device, of an indication to a user that the supply of the added cleaning agent is likely to be used up.

10. The method according to claim 1, the method further comprising outputting or triggering output, with the device, of an indication to a user relating to the amount of the added cleaning agent which has been poured into the dispensing apparatus of the cleaning device.

11. The method according to claim 1, the method further comprising measuring conductivity with the sensor apparatus, wherein sensing that the initial cleaning agent initially present in the dispensing apparatus has been flushed out of the dispensing apparatus comprises detecting a change in conductivity measured by the sensor apparatus.

12. The method according to claim 1, wherein sensing the added incremental amounts of the added cleaning agent which has been poured into the dispensing apparatus is performed during the process of flushing water through the dispensing apparatus.

13. The method according to claim 1, wherein:

the process of flushing water through the dispensing apparatus includes forming a mixture from the initial cleaning agent initially present in the dispensing apparatus and the water; and sensing, with the device, that the initial cleaning agent has been flushed out of the dispensing apparatus comprises sensing a conductivity of the mixture, wherein the device senses that the initial cleaning agent has been flushed out of the dispensing apparatus when the conductivity of the mixture falls below a specified threshold value.

14. The method according to claim 1, wherein sensing, with the sensor apparatus, the added amount of the added cleaning agent which has been poured into the dispensing apparatus comprises optically measuring an interior volume of the dispensing apparatus before and after the added amount of the added cleaning agent has been poured into the dispensing apparatus.

15. A method for operating a device comprising a dispensing apparatus and a sensor apparatus that are or are configured to be integrated in a cleaning device, the method comprising:

starting a process of flushing water through the dispensing apparatus to remove an initial cleaning agent initially present in the dispensing apparatus, sensing, with the device, that the initial cleaning agent has been flushed out of the dispensing apparatus, after sensing that the initial cleaning agent has been flushed out of the dispensing apparatus, ending, with the device, the process of flushing water through the dispensing apparatus, and sensing, with the sensor apparatus, added incremental amounts of an added cleaning agent poured into the dispensing apparatus, wherein the sensor apparatus comprises a sensor which analyzes transit times, and wherein sensing the added incremental amounts of the added cleaning agent comprises:

directing a pulse from the sensor to the added cleaning agent, wherein the pulse is reflected by the added cleaning agent to form a reflected pulse, receiving the reflected pulse with the sensor, measuring a transit time comprising an amount of time between directing the pulse and receiving the reflected pulse; and calculating each respective added incremental amount based on each respective transit time.

16. The method of claim 15 wherein the sensor which analyzes transit times is an optical sensor, an ultrasound-based sensor or a radar-based sensor.

17. The method of claim 15 further comprising identifying, with the sensor which analyzes transit times, the type of the added cleaning agent poured into the dispensing apparatus.

* * * * *